US010355369B1

(12) United States Patent
Dawson

(10) Patent No.: US 10,355,369 B1
(45) Date of Patent: Jul. 16, 2019

(54) ELEMENTAL CRESTED DIPOLE ANTENNA

(71) Applicant: The United States of America as represented by the Secretary of the Navy, Washington, DC (US)

(72) Inventor: David C. Dawson, Lemon Grove, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/974,297

(22) Filed: May 8, 2018

(51) Int. Cl.

| | |
|---|---|
| ***H01Q 9/16*** | (2006.01) |
| ***H01Q 21/06*** | (2006.01) |
| ***H01Q 1/48*** | (2006.01) |
| ***H01Q 9/26*** | (2006.01) |

(52) U.S. Cl.
CPC ..... *H01Q 21/062* (2013.01); *H01Q 1/48* (2013.01); *H01Q 9/16* (2013.01); *H01Q 9/26* (2013.01); *H01Q 21/067* (2013.01)

(58) Field of Classification Search
CPC .... H01Q 21/062; H01Q 21/067; H01Q 21/06; H01Q 9/16; H01Q 9/26; H01Q 1/48
See application file for complete search history.

(56) References Cited

U.S. PATENT DOCUMENTS

| | | | | |
|---|---|---|---|---|
| 4,812,855 | A | 3/1989 | Coe et al. | |
| 6,512,487 | B1 | 1/2003 | Taylor et al. | |
| 7,151,497 | B2 | 12/2006 | Crystal | |
| 7,855,690 | B2 * | 12/2010 | Hook | H01Q 1/38 343/754 |
| 8,878,742 | B1 * | 11/2014 | Jenn | H01Q 9/16 343/793 |

* cited by examiner

*Primary Examiner* — Hoang V Nguyen
(74) *Attorney, Agent, or Firm* — NIWC Pacific; Kyle Eppele; Young Fei

(57) ABSTRACT

Dipole antenna coupled to a source of excitation signals with center frequency of wavelength λ, comprising a first dipole element with a first feeder element electrically connected to a first radiating element and a first crested element electrically connected to the first radiating element. Second dipole element comprising a second feeder element electrically connected to the second radiating element. Groundplane electrically connected to first and second dipole elements. Antenna hole formed through first feeder element. Source of excitation signals received in the first feeder element the antenna hole, connected to the second feeder element. Parallel first and second feeder elements. Coaxial first and second radiating elements. Parallel first and second crested elements. The groundplane is orthogonal to the first and second dipole elements, and parallel to the first and second radiating element. First and second feeder elements, first and second radiating elements, and first and second crested elements measure 0.25λ.

20 Claims, 12 Drawing Sheets

100
0.25 λ
300
303
203
400
205
202
200
0.25 λ
304
0.25 λ
0.25 λ
0.25 λ
204
0.25 λ
500

ELEMENTAL CRESTED DIPOLE ANTENNA

FEDERALLY SPONSORED RESEARCH AND DEVELOPMENT

The Elemental Crested Dipole Antenna is assigned to the United States Government and is available for licensing and commercial purposes. Licensing and technical inquiries may be directed to the Office of Research and Technical Applications, Space and Naval Warfare Systems Center Pacific (Code 72120), San Diego, Calif., 92152 via telephone at (619) 553-2778 or email at ssc_pac_t2@navy.mil. Reference Navy Case 106890.

BACKGROUND OF THE INVENTION

1. Field of the Invention

The present invention relates to the field of dipole antenna elements, and especially to the use of such antenna elements as standalone elements or as part of an array.

2. Description of the Related Art

Half-wave dipole antennas are one of the most basic types of elemental antennas, and are some of the most efficient radiators in existence. However, by today's standards, conventional half-wave dipole antennas are narrowband and tend to only radiate efficiently at the center frequency for which they have been designed. The impedance of existing conventional half-wave dipole antennas is about 73Ω. This input impedance presents a mismatch when conventional half-wave dipole antennas are connect to standard 50Ω coaxial cables and radio-frequency (RF) systems. This impedance mismatch severely reduces the already narrow band of efficient radiation, and usually requires that the prior art conventional half-wave dipole antennas be matched to the 50Ω input source via a number of different techniques.

The ideal performance of conventional half-wave dipole antennas is usually obtained by performing mathematical analysis or computational simulations in free space scenarios. Practical existing half-wave dipole antennas however, need to be mounted to or supported by additional real physical structures. These real physical structures tend to detune, absorb, or otherwise interfere with the ideal mode of dipole radiation. Additionally, ideal dipole antennas are electrically balanced devices. Thus, when the half-wave dipole antenna is connected to unbalanced input cables (such as coaxial cables), different current densities are formed in each arm of the dipole. These different current densities can also flow through the outer shield of the coaxial cable, generating a deteriorated radiation pattern that is not symmetrical (as the ideal dipole antenna would produce). Different techniques however, exist to feed balanced devices with unbalanced cables, or unbalanced devices with balanced cables. For example, balanced-to-unbalanced (balun) devices of different types are frequently used. However, these balun devices are also narrowband in nature and tend to reduce the frequency band of efficient radiation even more.

SUMMARY OF THE INVENTION

The present invention is a dipole antenna coupled to a source of excitation signals with a center frequency of wavelength λ. An embodiment of the dipole antenna comprises a first dipole element. The first dipole element comprises a first feeder element electrically connected to a first radiating element and a first crested element electrically connected to the first radiating element. The dipole antenna comprises a second dipole element. The second dipole element comprises a second feeder element electrically connected to the second radiating element and a second crested element electrically connected to the second radiating element. The dipole antenna further comprises a groundplane electrically connected to the first dipole element and the second dipole element.

The first dipole element has an antenna hole formed through it. The source of excitation signals is received in the first feeder and through it and in the antenna hole. The source of excitation signals is additionally connected to the second dipole element. The first feeder element is parallel with the second feeder element. The first radiating element is coaxial with the second radiating element. The first crested element is parallel with the second crested element. The first feeder element is orthogonal to the first radiating element. The first crested element is orthogonal to the first radiating element. The second feeder element is orthogonal to the second radiating element. The second crested element is orthogonal to the second radiating element. The groundplane is orthogonal to the first dipole element and second dipole element. The groundplane is parallel to the first radiating element and the second radiating element. The length of the first feeder element, second feeder element, first radiating element, second radiating element, and the height of the first crested element and second crested element measures approximately 0.25λ.

BRIEF DESCRIPTION OF THE DRAWINGS

Throughout the several views, like elements are referenced using like elements. The elements in the figures are not drawn to scale, and some dimensions may be exaggerated for clarity.

DETAILED DESCRIPTION OF THE INVENTION

While this invention may be embodied in different forms, the drawings and this section describe in detail specific embodiments of the invention with the understanding that the present disclosure is to be considered merely a preferred embodiment of the invention, and is not intended to limit the invention in any way.

Prior art conventional dipole antennas may use a balanced-to-unbalanced transformer (balun) as is known in the art. The balun may be used to evenly maximize the current distribution between the dipoles. In addition to the transformer function, the balun may also serve as a physical support structure. Despite being conductive, the balun is electrically open circuited to the groundplane, thereby preventing current from flowing from the dipoles to the groundplane.

While the use of balun devices and physical support structures with conventional dipole antennas is well known in the art, the present invention is able to embody at least three of the essential characteristics of the prior art dipole antenna, but doesn't require a balun or separate support structure: (1) the present invention has a good impedance match between the source of the excitation signals (e.g., a coaxial cable) and the dipole antenna; (2) the present invention may have an electrically balanced feed to maximize current distribution; and (3) the present invention may include an intrinsic functional physical support, making it ideal for use in a variety of different radar and communications applications.

As used in the body of the specification and in the claims, the term "crest" means "a flattened projecting surface or attachment on a device." In the body of the specification and in the claims, the term "crested" is the adjective form of "crest."

Figure 1:
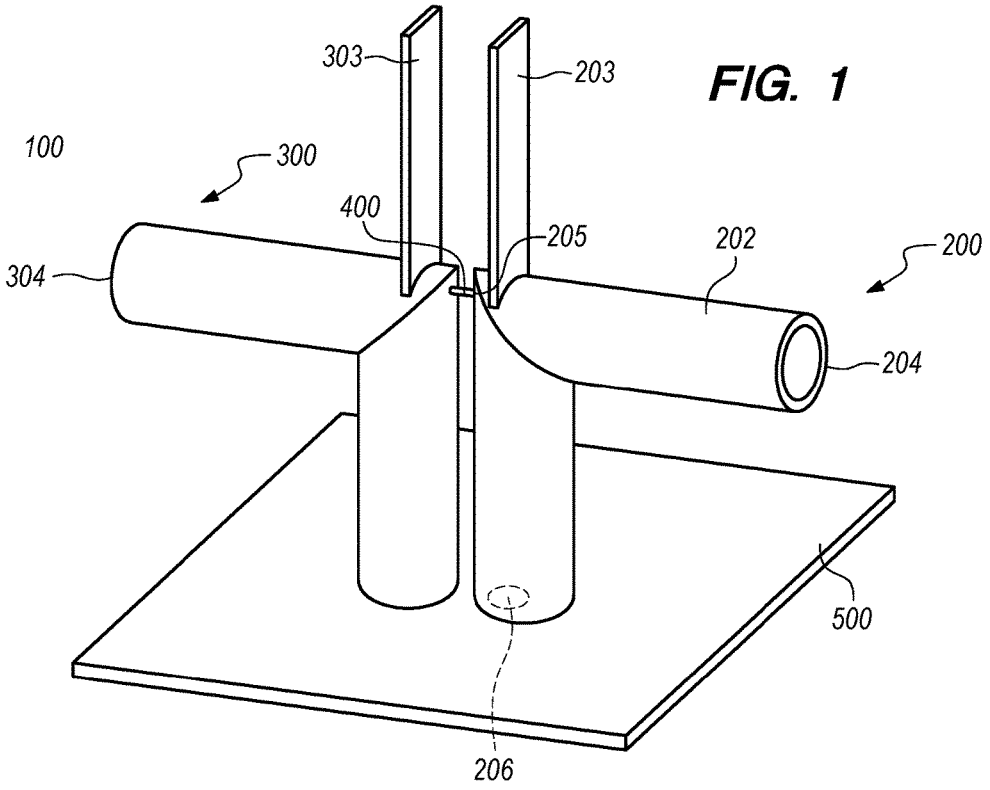
FIG. 1 depicts an isometric view of an embodiment of an Elemental Crested Dipole Antenna according to the present invention.
Figure 2:
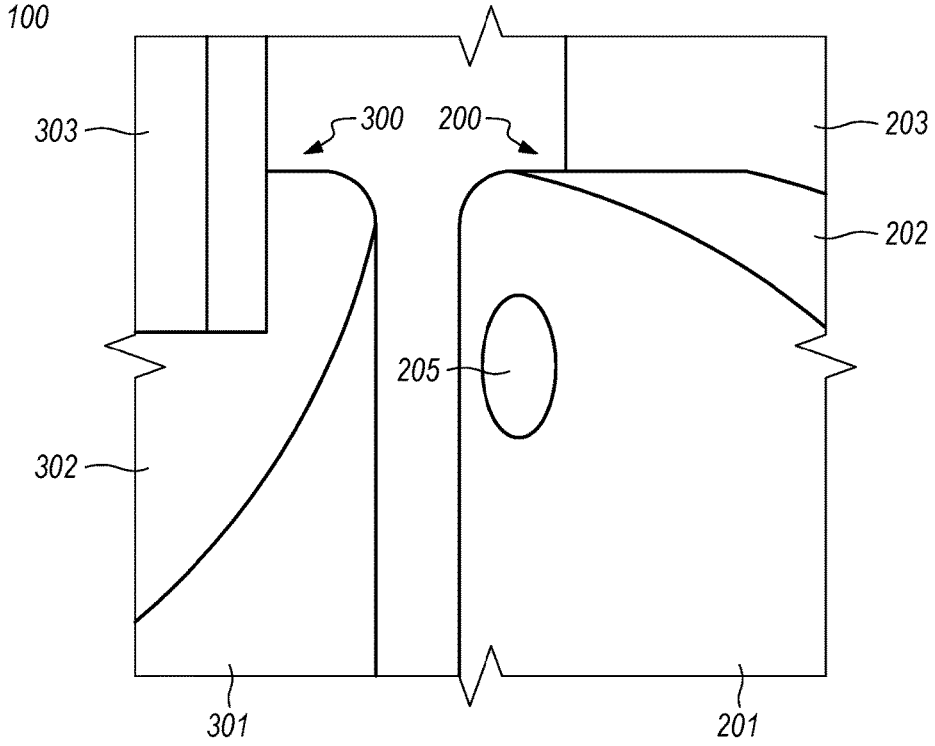
FIG. 2 depicts a front view of an embodiment of the present invention.
Figure 3:
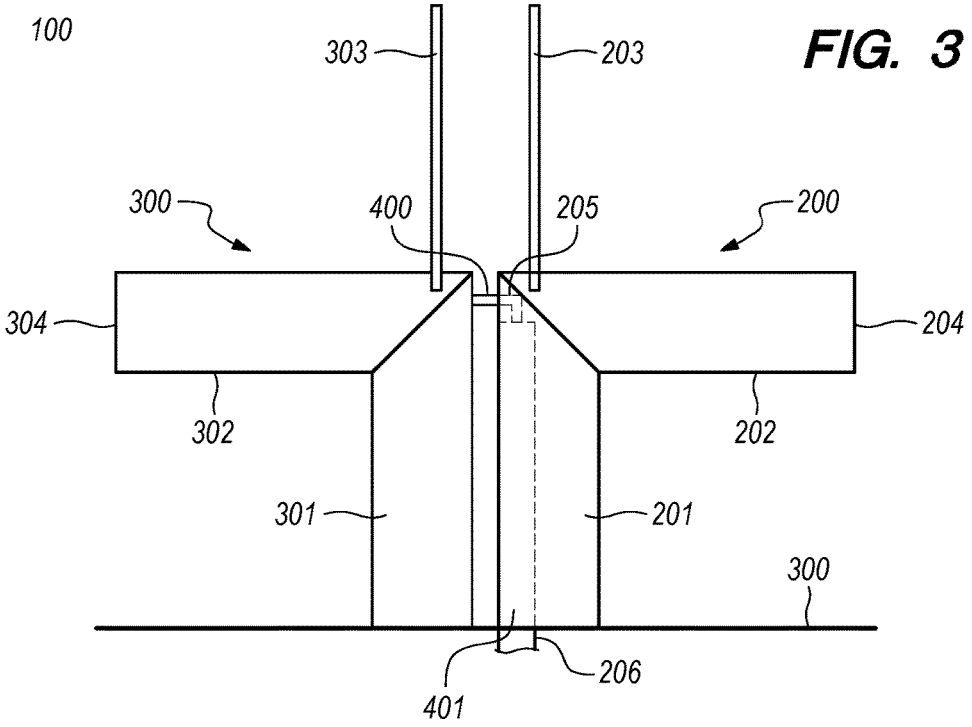
FIG. 3 depicts an isometric view of an embodiment of the present invention.

As depicted in FIG. 1, an embodiment of the present invention, the elemental crested dipole antenna 100 comprises a first dipole element 200 and a second dipole element 300. The first dipole element 200 comprises a first feeder element 201 electrically attached and orthogonal to a first radiating element 202, and a first crested element 203 electrically attached and orthogonal to the first radiating element 202. In this embodiment, the first feeder element 201 and the first radiating element 202 may be made from a tubular hollow cylinder made from brass. The first crested element 203 is substantially rectangular in shape, and made from brass. The first feeder element 201 may have an antenna hole 205 formed near the top of the first radiating element 202 where the first crested element 203 attaches. FIG. 2 depicts the source of excitation signals 400 as it is fed through the source feeder hole 206 formed through the groundplane 500 where the groundplane 500 attaches to the first feeder element 201. In this embodiment, the source of excitation signals 400 is a conventional 50Ω coaxial cable, whose shielding attaches at the feeder hole 206, and whose center conductor attaches to the second feeder element 301 after being bent and fed through the antenna hole 205. FIG. 3 depicts the antenna hole 205 in greater detail. The groundplane 500 is also made from brass, and the first feeder element attaches orthogonally to the groundplane 500.

Figure 4:
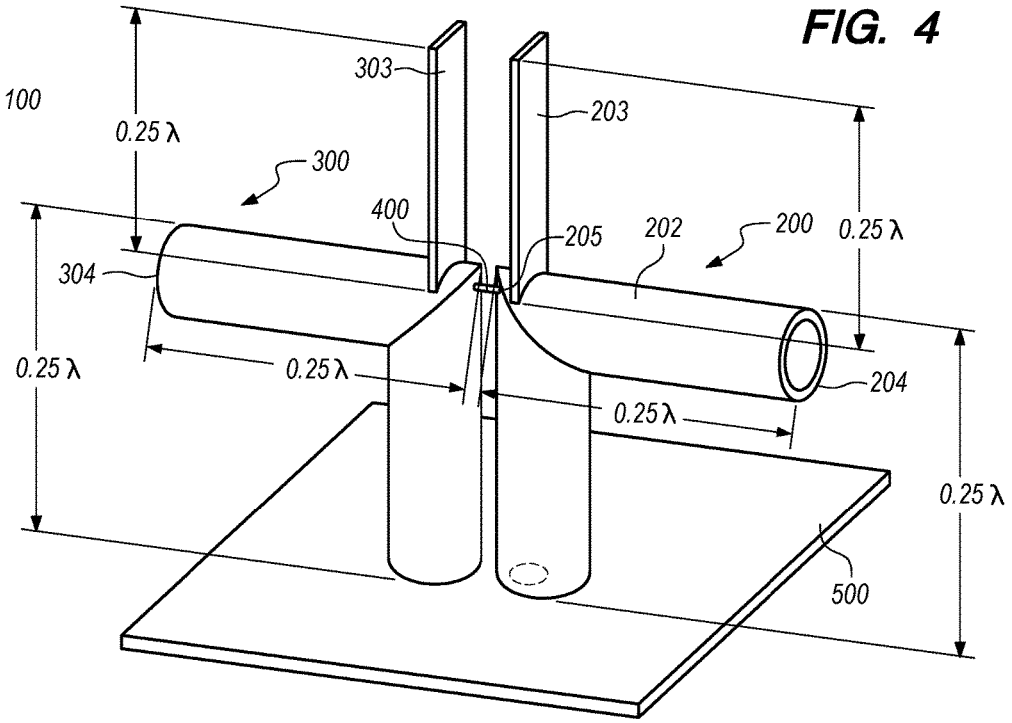
FIG. 4 depicts an isometric view of an embodiment of the present invention.

The second dipole element 300 comprises a second feeder element 301 electrically attached and orthogonal to a second radiating element 302, and a second crested element 303 electrically attached and orthogonal to the second radiating element 302. In this embodiment, the second feeder element 301 and the second radiating element 302 may be made from a tubular hollow cylinder made from brass. The second crested element 303 is substantially rectangular in shape, and made from brass. In this embodiment (depicted in FIG. 4), the length of the first feeder element 201, first radiating element 202, first crested element 203, second feeder element 301, second radiating element 302, and second crested element 303 is approximately 0.25λ, wherein λ is the wavelength of the center frequency for which the present invention is optimized.

Figure 5:
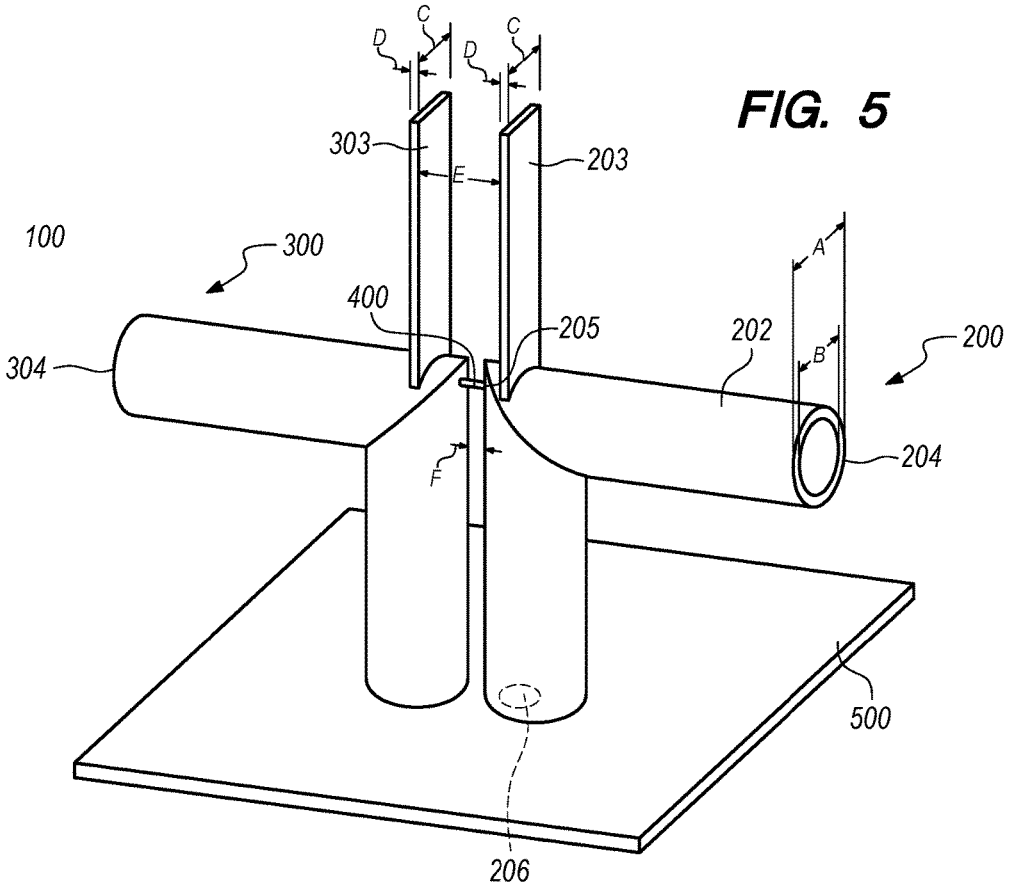
FIG. 5 depicts an isometric view of an embodiment of the present invention.

In the present embodiment, the elemental crested dipole antenna 100 is optimized for performance at a center frequency of 1.96 GHz. As such, λ is 15.3 cm in this embodiment. FIG. 5 depicts additional dimensions of the present embodiment. The first radiating element 202 and the second radiating element 302 have a first diameter A of 9.5 mm (the outer diameter) and a second diameter B of 7.8 mm (the inner diameter). In addition to their length of 0.25λ, the first crested element 203 and the second crested element 303 have a width C of 8.0 mm and a thickness D of 0.8 mm. In the present embodiment, the first crested element 203 is parallel to the second crested element 303 and spaced a crest spacing distance E of 8.2 mm apart. The first feeder element 201 is parallel to the second feeder element 301 and spaced a dipole spacing distance F of 2.6 mm apart. Additionally, in the present embodiment, the first radiating element 202 is coaxial with the second radiating element 302, and both are parallel to the groundplane 500.

Figure 8A:
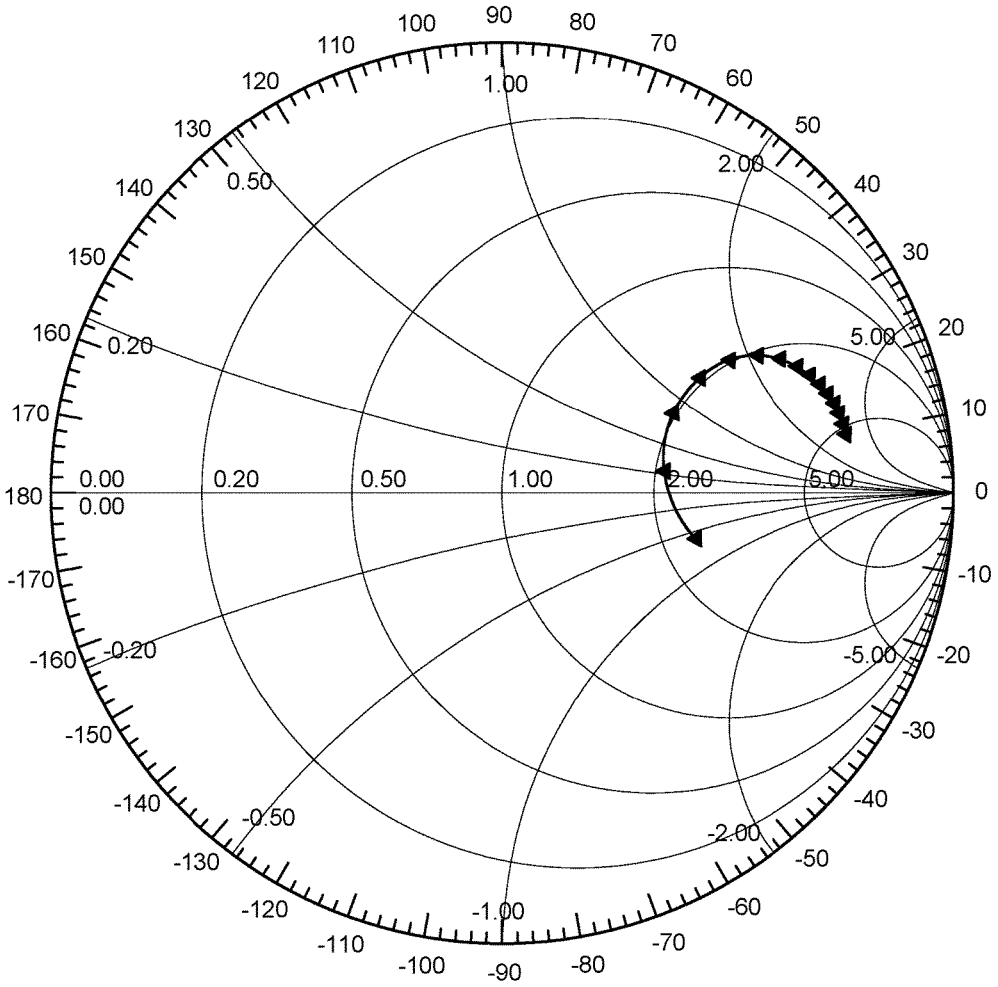
FIG. 8A depicts a Smith chart showing the performance of a conventional dipole antenna.
Figure 8B:
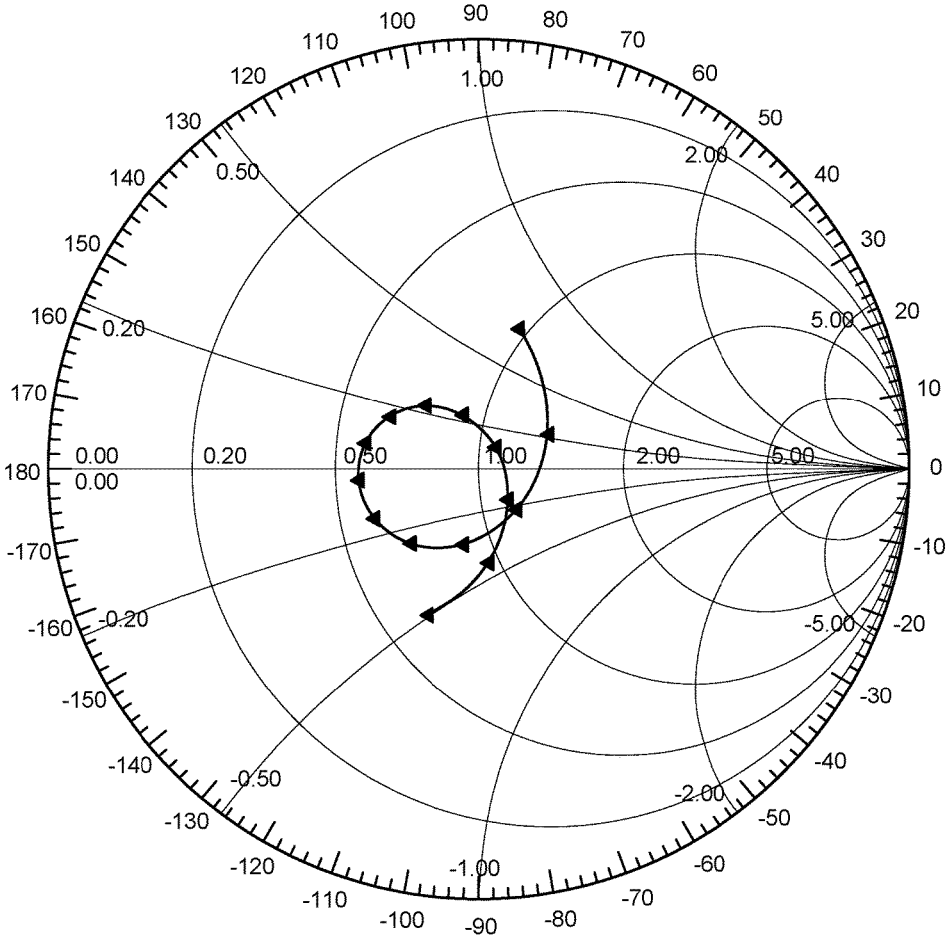
FIG. 8B depicts a Smith chart showing the performance of an embodiment of the present antenna.
Figure 9:
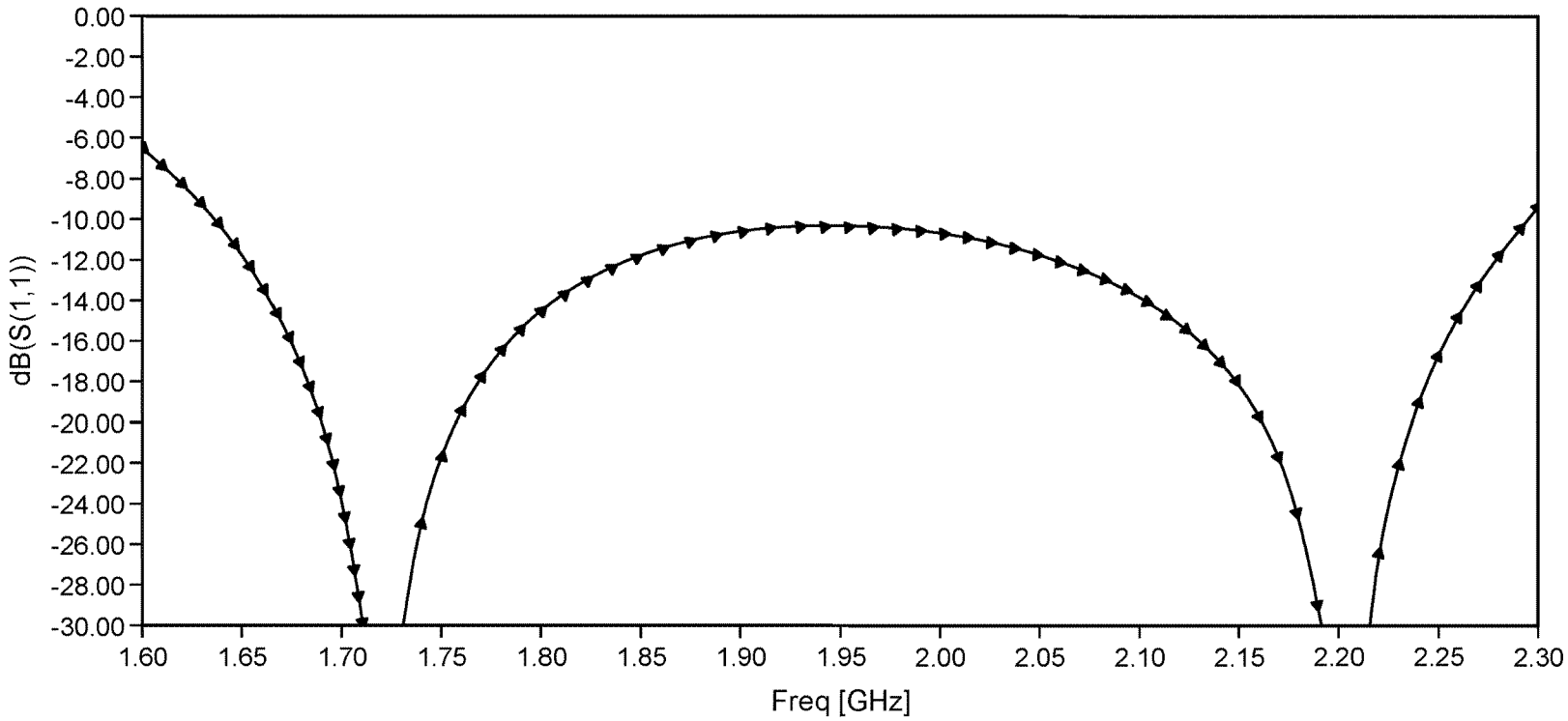
FIG. 9 depicts a return loss plot of an embodiment of the present invention.

The first crested element 203 and second rested element 303 of the elemental crested dipole antenna 100 serve to enhance input impedance matching. FIGS. 8A and 8B show Smith charts comparing the performance of a conventional prior art dipole, FIG. 8A, and the performance of the present embodiment of the invention, FIG. 8B. Both antennas were connected to the same standard 50Ω coaxial cable source of excitation signals 400. FIG. 9 depicts the performance of the present embodiment by depicting a return loss plot. The present embodiment is capable of both transmitting and receiving RF signals.

Figure 6:
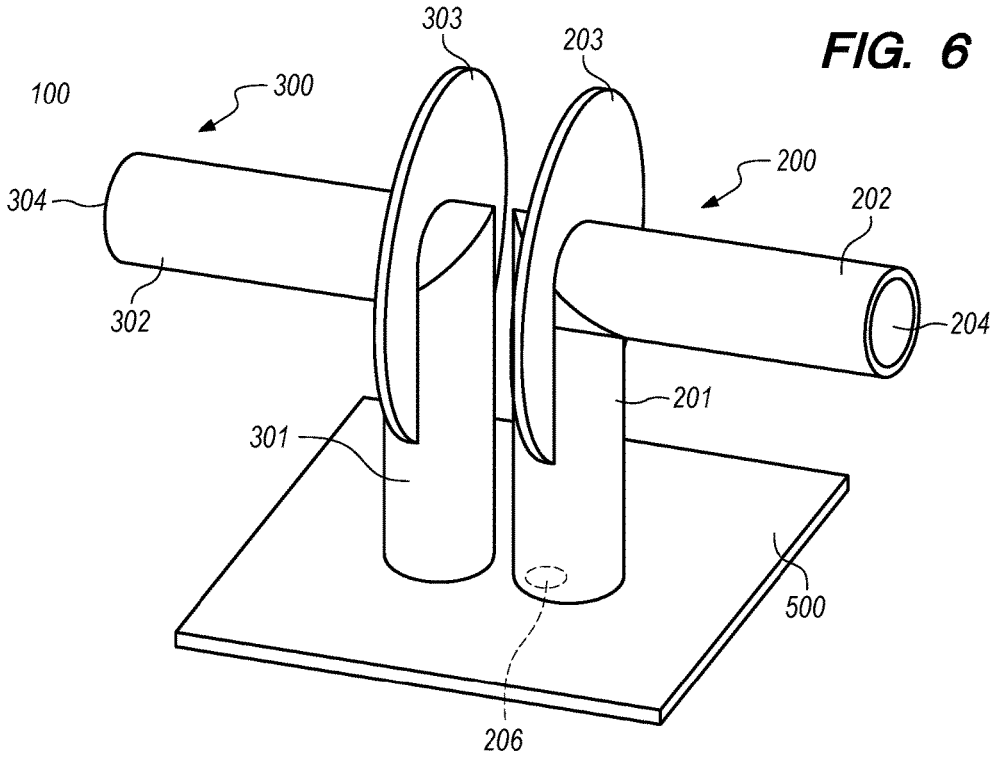
FIG. 6 depicts isometric view of an embodiment of the present invention with substantially circular crests.

It should be noted that while in the present embodiment the first crested element 203 and the second rested element 303 are substantially rectangular, the crested elements may be other shapes. For example, FIG. 6 depicts an embodiment of the invention where the first crested element 203 and the second crested element 303 are substantially circular. In such a configuration the diameter of the first crested element 203 and the second crested element 303 measures approximately 0.25λ.

Figure 7:
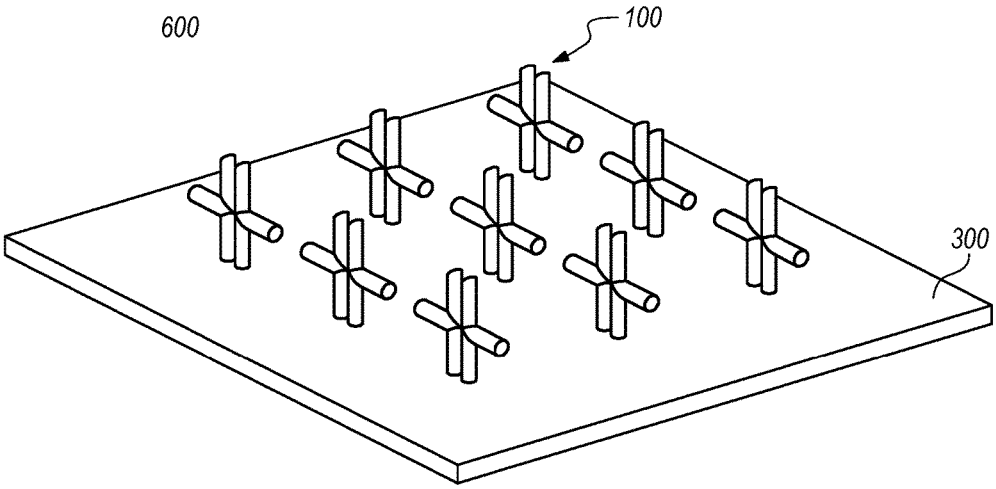
FIG. 7 depicts an isometric view of an embodiment of the present invention configured as an array of dipole antennas.
Figure 10:
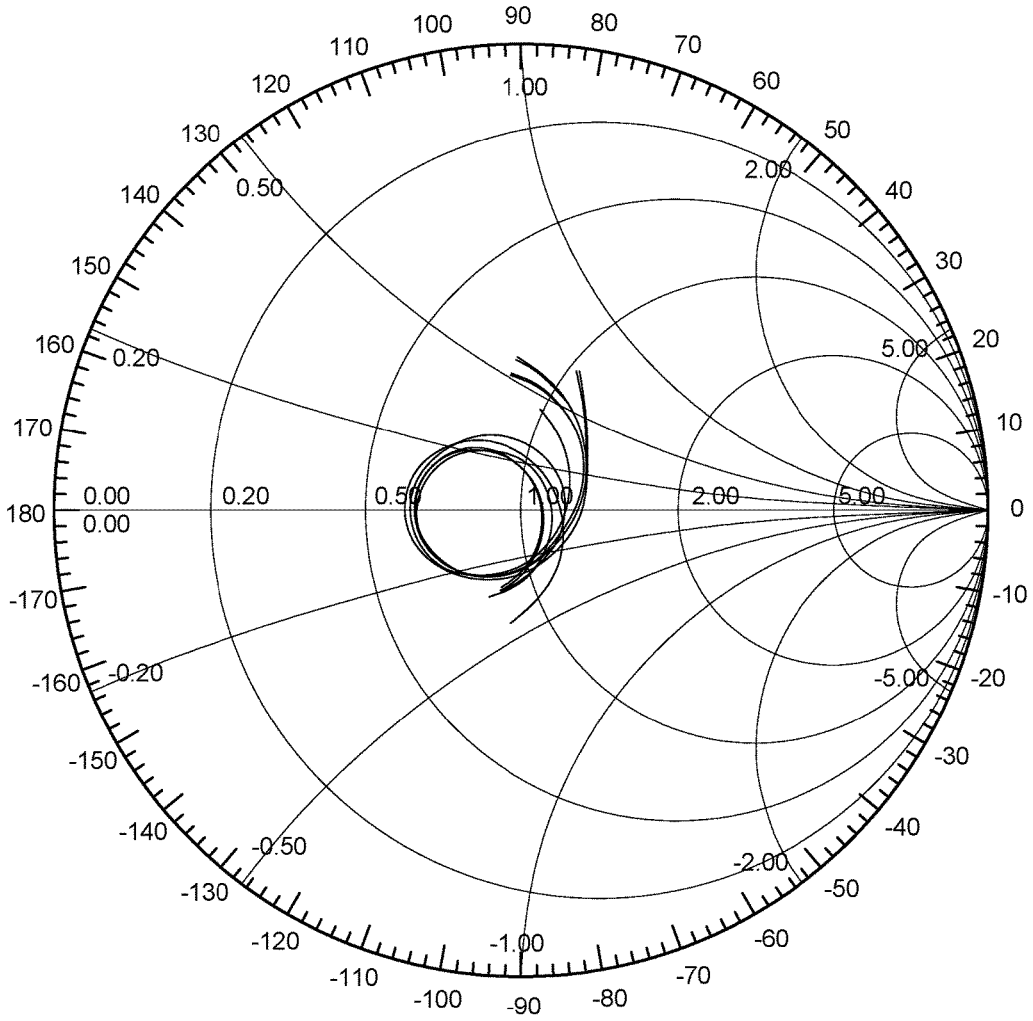
FIG. 10 depicts a simulated Smith chart showing the performance of an array of antennas according to an embodiment of the present invention.
Figure 11:
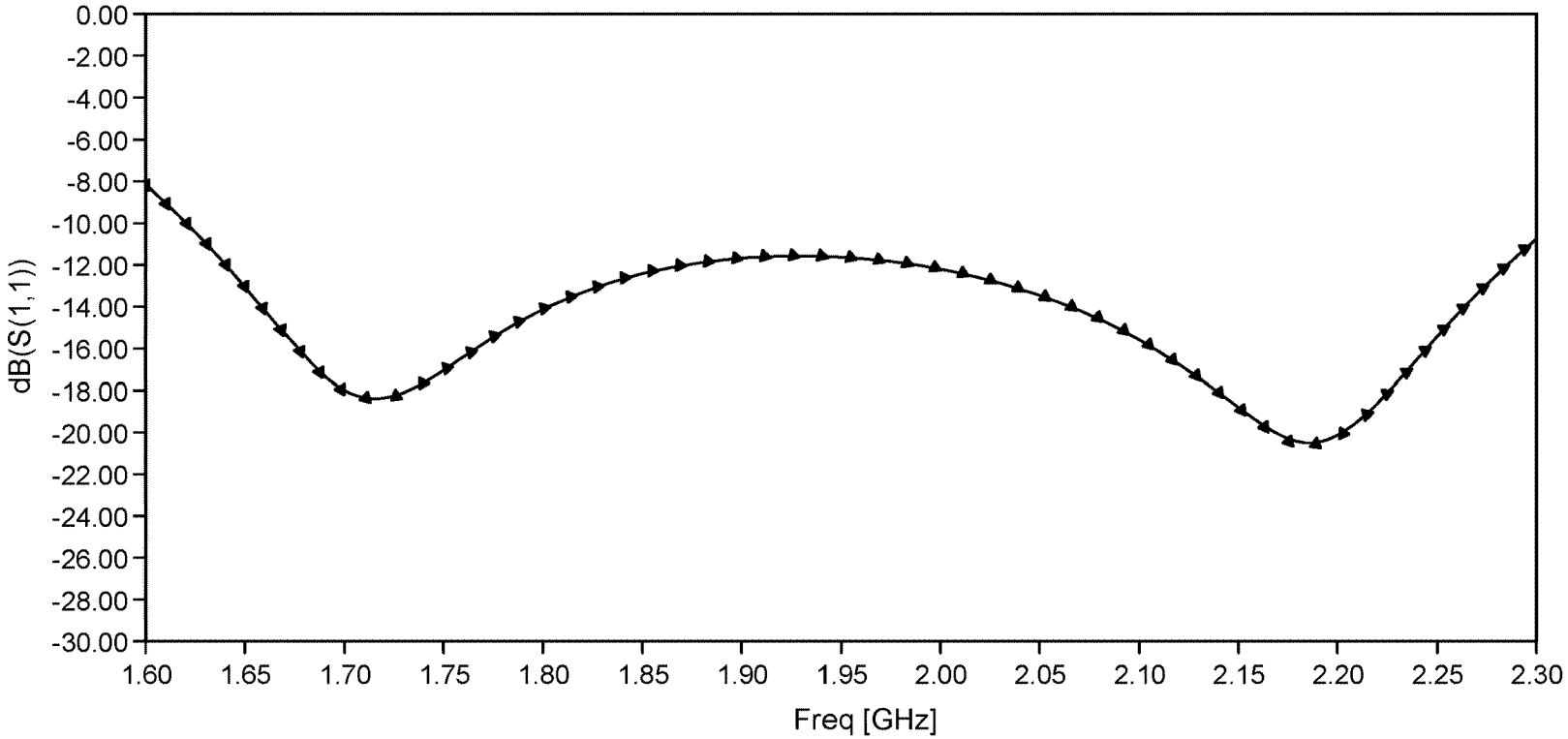
FIG. 11 depicts a simulated return loss plot of an array of antennas according to an embodiment of the present invention.

Another embodiment of the present invention is a configuration where the elemental crested dipole antennas 100 form an array, with each elemental crested dipole antenna 100 being electrically and orthogonally attached to the groundplane 500. FIG. 7 depicts an array of nine elemental crested dipole antennas 100, with each elemental crested dipole antenna 100 configured as described in paragraphs 0022 to 0025. In this embodiment, each elemental crested dipole antenna 100 is arranged on the groundplane 500 with a horizontal spacing of 8.9 cm and a vertical spacing of 12.7 cm. FIG. 10 depicts a Smith chart showing the simulated performance of this embodiment. Likewise, FIG. 11 depicts a simulated return loss plot for this embodiment.

Additionally, various structures may act as the groundplane 500. For example, masts and other structures that the dipole antenna 100 attach to may function effectively as a groundplane 500.

From the foregoing description, it will be apparent that the present invention has a number of advantages, some of which have been described above, and others of which are inherent in the embodiments of the invention described above. Also, it will be understood that modifications can be made to the elemental crested dipole antenna described above without departing from the teachings of subject matter described herein. As such, the invention is not to be limited to the described embodiments except as required by the appended claims.

What is claimed is:

1. A dipole antenna coupled to a source of excitation signals having a center frequency of wavelength λ, the dipole antenna comprising:

a first dipole element comprising a first feeder element electrically connected to a first radiating element, a first crested element electrically connected to the first radiating element;

a second dipole element comprising a second feeder element electrically connected to a second radiating element, a second crested element electrically connected to the second radiating element;

a groundplane electrically connected to the first dipole element and the second dipole element;

wherein the first dipole element has an antenna hole formed therethrough, wherein the source of excitation signals is received in the first feeder, wherein the source of excitation signals is received in the antenna hole, wherein the source of excitation signals is electrically connected to the second dipole element;

wherein the first feeder element is parallel with the second feeder element, wherein the first radiating element is coaxial with the second radiating element, wherein the first crested element is parallel with the second crested element, wherein the first feeder element is orthogonal to the first radiating element, wherein the first crested element is orthogonal to the first radiating element, wherein the second feeder element is orthogonal to the second radiating element, wherein the second crested element is orthogonal to the second radiating element, wherein the groundplane is orthogonal to the first dipole element and second dipole element, wherein the groundplane is parallel to the first radiating element and the second radiating element; and wherein a length of the first feeder element measures approximately 0.25λ, wherein a length of the second feeder element measures approximately 0.25λ, wherein a length of the first radiating element measures approximately 0.25λ, wherein a length of the second radiating element measures approximately 0.25λ, wherein a height of the first crested element measures approximately 0.25λ, wherein a height of the second crested element measures approximately 0.25λ.

2. The dipole antenna of claim 1, wherein the first dipole element and the second dipole element are made from brass.

3. The dipole antenna of claim 1, wherein the wavelength λ measures approximately 15.3 cm.

4. The dipole antenna of claim 1, wherein a first diameter of the first radiating element measures approximately 9.5 mm.

5. The dipole antenna of claim 1, wherein a second diameter of the first radiating element measures approximately 7.8 mm.

6. The dipole antenna of claim 1, wherein a crest width of the first rested element measures approximately 8.0 mm.

7. The dipole antenna of claim 1, wherein a crest width of the second crested element measures approximately 8.0 mm.

8. The dipole antenna of claim 1, wherein a crest thickness of the first crested element measures approximately 0.8 mm.

9. The dipole antenna of claim 1, wherein a crest thickness of the second crested element measures approximately 0.8 mm.

10. The dipole antenna of claim 1, wherein a crest spacing distance between the first crested element and the second crested element measures approximately 8.3 mm.

11. The dipole antenna of claim 1, wherein a dipole spacing distance between the first feeder element and the second feeder element measures approximately 2.6 mm.

12. The dipole antenna of claim 1, wherein the first crested element is substantially rectangular.

13. The dipole antenna of claim 1, wherein the second crested element is substantially rectangular.

14. The dipole antenna of claim 1, wherein the first crested element is substantially circular.

15. The dipole antenna of claim 1, wherein the second crested element is substantially circular.

16. A dipole antenna coupled to a source of excitation signals having a center frequency of wavelength λ, the dipole antenna comprising:

a first dipole element comprising a first feeder element electrically connected to a first radiating element, a first crested element electrically connected to the first radiating element;

a second dipole element comprising a second feeder element electrically connected to a second radiating element, a second crested element electrically connected to the second radiating element;

a groundplane electrically connected to the first dipole element and the second dipole element;

wherein the first dipole element has an antenna hole formed therethrough, wherein the source of excitation signals is received in the first feeder, wherein the source of excitation signals is received in the antenna hole, wherein the source of excitation signals is electrically connected to the second dipole element;

wherein the first feeder element is parallel with the second feeder element, wherein the first radiating element is coaxial with the second radiating element, wherein the first crested element is parallel with the second crested element, wherein the first feeder element is orthogonal to the first radiating element, wherein the first crested element is orthogonal to the first radiating element, wherein the second feeder element is orthogonal to the second radiating element, wherein the second crested element is orthogonal to the second radiating element, wherein the groundplane is orthogonal to the first dipole element and second dipole element, wherein the groundplane is parallel to the first radiating element and the second radiating element;

wherein a length of the first feeder element measures approximately 0.25λ, wherein a length of the second feeder element measures approximately 0.25λ, wherein a length of the first radiating element measures approximately 0.25λ, wherein a length of the second radiating element measures approximately 0.25λ, wherein a height of the first crested element measures approximately 0.25λ, wherein a height of the second crested element measures approximately 0.25λ; and wherein the first dipole element is made from brass, wherein the second dipole element is made from brass, wherein the first crested element is substantially rectangular, wherein the second crested element is substantially rectangular, wherein the wavelength λ measures approximately 15.3 cm, wherein a first diameter of the first radiating element measures approximately 9.5 mm, wherein a second diameter of the first radiating element measures approximately 7.8 mm, wherein a crest width of the first crested element measures approximately 8.0 mm, wherein a crest width of the second crested element measures approximately 8.0 mm, wherein a crest thickness of the first crested element measures approximately 0.8 mm, wherein a crest thickness of the second crested element measures approximately 0.8 mm, wherein a crest spacing distance between the first crested element and the second crested element measures approximately 8.3 mm, wherein a dipole spacing distance between the first feeder element and the second feeder element measures approximately 2.9 mm.

17. A dipole array antenna comprising:

a groundplane;

an array of dipole antenna elements, each dipole antenna element comprising a first dipole element comprising a first feeder element electrically connected to a first radiating element, a first crest element electrically connected to the first radiating element;

a second dipole element comprising a second feeder element, a second crested element electrically connected to the second radiating element;

wherein the first feeder element is parallel with the second feeder element, wherein the first radiating element is coaxial with the second radiating element, wherein the first crested element is parallel with the second crested element, wherein the first feeder element is orthogonal to the first radiating element, wherein the first crested element is orthogonal to the first radiating element, wherein the second feeder element is orthogonal to the second radiating element, wherein the second crested element is orthogonal to the second radiating element;

wherein a length of the first feeder element measures approximately 0.25λ, wherein a length of the second feeder element measures approximately 0.25λ, wherein a length of the first radiating element measures approximately 0.25λ, wherein a length of the second radiating element measures approximately 0.25λ, wherein a height of the first crested element measures approximately 0.25λ, wherein a height of the second crested element measures approximately 0.25λ; and wherein the first dipole element is electrically connected to the groundplane; wherein the second dipole element is electrically connected to the groundplane; wherein the groundplane is orthogonal to the first dipole element and second dipole element, wherein the groundplane is parallel to the first radiating element and the second radiating element.

18. The array of claim 17, wherein each first dipole element is made from brass, wherein each second dipole element is made from brass, wherein each first crested element is substantially rectangular, and wherein each second crested element is substantially rectangular.

19. The array of claim 17, wherein the wavelength λ measures approximately 15.3 cm.

20. The array of claim 17, wherein a first diameter of each first radiating element measures approximately 9.5 mm, wherein a second diameter of each first radiating element measures approximately 7.8 mm, wherein a crest width of each first crested element measures approximately 8.0 mm, wherein the crest width of each second crested element measures approximately 8.0 mm, wherein a crest thickness of each first crested element measures approximately 0.8 mm, wherein the crest thickness of each second crested element measures approximately 0.8 mm, wherein a crest spacing distance between each first crested element and each second crested element measures approximately 8.3 mm, and wherein a dipole spacing distance between each first feeder element and each second feeder element measures approximately 2.6 mm.

* * * * *